United States Patent [19]

Kunreuther

[11] Patent Number: 4,889,272

[45] Date of Patent: Dec. 26, 1989

[54] AUTOMATIC APPARATUS FOR ATTACHING TAGS TO LABELS PREVIOUSLY AFFIXED TO GARMENTS

[76] Inventor: Steven J. Kunreuther, 285 Central Park West, New York, N.Y. 10023

[21] Appl. No.: 307,514

[22] Filed: Feb. 8, 1989

[51] Int. Cl.[4] ..... B65L 7/00; B31F 7/00

[52] U.S. Cl. ..... 227/4; 227/67

[58] Field of Search ..... 29/432; 227/28, 67, 227/4

[56] References Cited

U.S. PATENT DOCUMENTS

| | | | |
|---|---|---|---|
| 4,235,161 | 11/1980 | Kunreuther | 227/28 X |
| 4,718,158 | 1/1988 | Block | 29/432 |
| 4,781,318 | 11/1988 | Meyers | 227/67 |

*Primary Examiner*—Paul A. Bell

*Attorney, Agent, or Firm*—James & Franklin

[57] ABSTRACT

Automatic tag attaching apparatus having a fixedly mounted attacher with a hollow fastener dispensing needle is improved. A hollow, size adjustable anvil is adapted to be received between a woven label and the garment to which it is affixed, to keep the label taut and separate it from the garment. In one preferred embodiment, the anvil is moved downwardly over the needle upon which tags have been previously placed, such that the needle penetrates the label and a fastener can be dispensed. The anvil is then moved upwardly, to a position remote from the needle, to permit the tagged garment to be removed and new tags placed over the needle. In the most preferred embodiment, after the anvil returns to its position remote from the needle, it is moved horizontally to remove it from the garment. Thereafter, the anvil is moved back into alignment with the needle to receive the next garment.

21 Claims, 13 Drawing Sheets

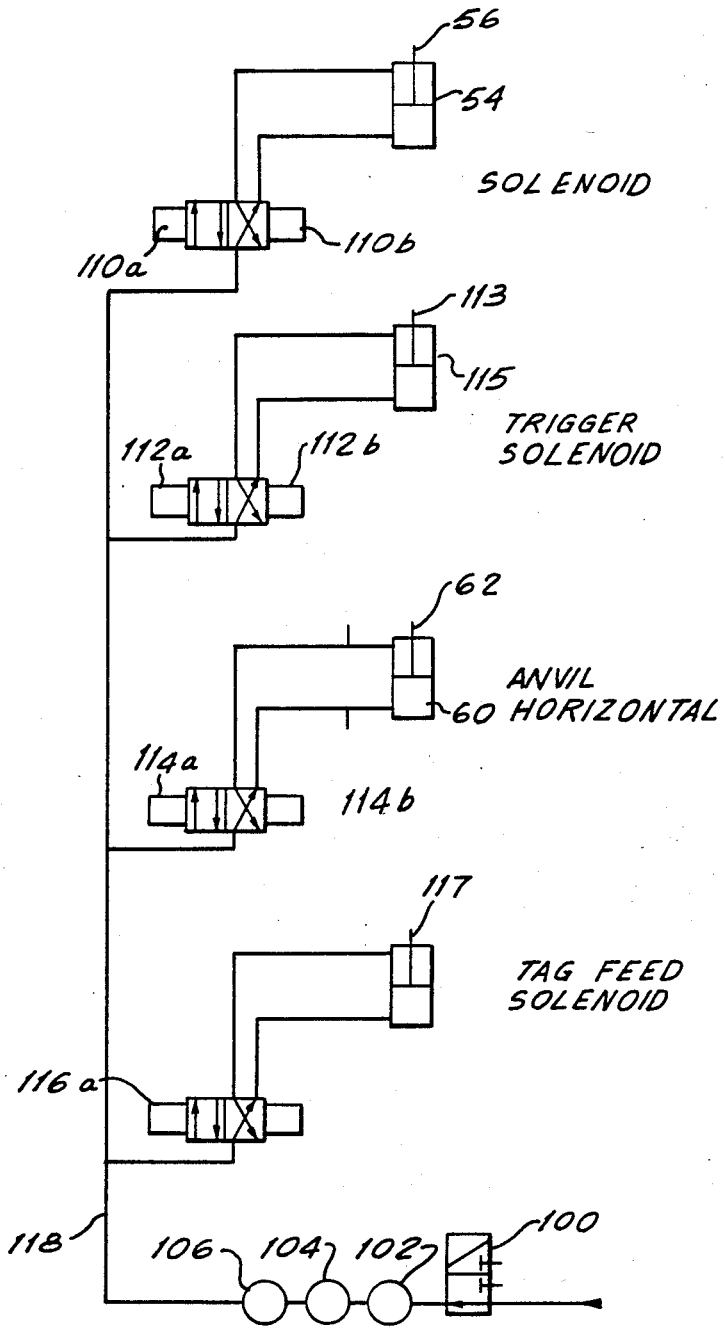
56
54
SOLENOID
110a
110b
113
115
TRIGGER
SOLENOID
112a
112b
62
ANVIL
HORIZONTAL
60
114a
114b
117
TAG FEED
SOLENOID
116a
118
106
104
102
100

AUTOMATIC APPARATUS FOR ATTACHING TAGS TO LABELS PREVIOUSLY AFFIXED TO GARMENTS

The present invention relates to tag attaching apparatus and more particularly to an improved automatic tag attaching apparatus adapted to attach tags to labels which have been previously affixed to garments.

Various industries require that tags be attached to merchandise prior to sale. For example, in the retail wearing apparel industry, millions of garments are routinely provided with tags which contain information concerning pricing, inventory control and the like. Because of the great number of articles which must be tagged, it is necessary that the tagging operation be performed as expediously and inexpensively as possible. However, the tagging operation must be performed in a matter which reduces theft and tag switching as much as possible.

One of the most widely used tag attaching systems includes a hand held tag attacher or gun into which a clip or coil of plastic attachments or fasteners is received. Each of the fasteners includes a T-bar and an enlarged paddle end connected by a relatively thin flexible plastic filament. Actuation of the attacher causes the T-bar of the fastener to be dispensed through a hollow needle situated on the forward end of the attacher.

When the needle is inserted through an opening in an article and through a hole in the tag, and the attacher is actuated, the T-bar end of the fastener will travel through the needle and, thereafter, be situated on one side of the garment with the paddle end remaining on the other. This system permits a low cost tagging operation, because a minimum of unskilled labor is required and the cost of the plastic attachments and the attacher is relatively small. Further, the tagging operation can be accomplished within a few seconds. Security is assured because the fastener is made of strong plastic, such as polypropylene or nylon, which prevents the tag from being removed except by destruction of the article or tag or by cutting the filament of the fastener.

Fasteners and attachers of this type are are commercially available. Dennison Manufacturing Company of Framingham, Massachusetts and Texpak, Inc. of Franklin Square, New York are two sources. The fasteners and attachers are widely used throughout this country and many other countries of the world.

Although the attachers are primarily designed for hand held use, when large numbers of tagging operations are required, automation of the tag attaching operation is desirable. One highly commercially successful automatic tag attaching apparatus is described in detail in my U.S. Pat. No. 4,235,161 issued Nov. 25, 1980 and entitled AUTOMATIC TAG ATTACHING APPARATUS.

My patent describes an apparatus in which a conventional hand held fastener attacher is vertically mounted to a support in a fixed position in a manner which permits pneumatic actuation thereof. A carriage, which is moveable along an upstanding guide situated on the support, has mounted thereon a pneumatically actuated tag feed mechanism. When actuated, the mechanism feeds a tag from a position out of alignment with the axis of the needle of the attacher to a position in alignment with the axis of the needle.

Thereafter, the carriage is moved towards the attacher to place the tag on the needle. In one embodiment, a second carriage, moveable along a second upstanding guide, carries either a hook feed mechanism or an additional tag feed mechanism which, when actuated, feed a hook or tag and places same on the needle.

The article to which the tag and hook are to be attached is held such that it is penetrated by the needle. The attacher is then actuated to dispense a fastener to attach the tag and hook to the article. The tags and/or hooks are positioned on the needle prior to the actuation of the attacher, such that multiple tags or hooks may be attached to the article in a single automatic operation.

The automatic tag attaching apparatus described in the above identified patent has been commercially successful because it is easily adaptable to a wide variety of different applications. It can be used to tag a variety of different types of garments. It can be set up to feed one, or several tags, as required for a particular operation. It can be set up fairly quickly and its operation can be learned in a minimal time, even by unskilled operators.

However, after several years use in the field, it has been determined that my patented automatic tag attaching apparatus is not suitable for operations where tags are to be attached only to selected layers in multi-layer articles, such as where a woven label already has been previously affixed to a garment. An example of this occurs in the men's necktie and shirt industries. Men's neckties are sold with a woven label on to the undersurface thereof. Similarily, shirts are sold with a woven label in the collar. The label is sewn to the garment with stitching at either end of the label prior to tagging.

My patented automatic tag attaching apparatus cannot be used to attach tags to such labels because the label is situated in close face to face relationship with the surface of the garment. If placed on my patented apparatus, the needle (and hence the fasteners) would penetrate not only the label but also the garment itself causing damage to the garment and making it unsalable. It is, therefore a general object of the present invention, to improve my patented automatic tag attaching apparatus to permit same to automatically attach tags to only a selected layer of a multi-layer article, such as a label which has been previously affixed to a garment.

An attempt to deal with a similar problem is discussed in U.S. Pat. No. 4,718,158issued Jan. 12, 1988 to Charles Block and entitled AUTOMATIC TAGGING APPARATUS AND METHOD THEREFOR. That patent describes a method and apparatus for automatically tagging selected layers of multi-layer articles. A clamp is used for holding the selected layers in a tagging position while the tag is fed and tacked.

The Block apparatus utilizes a moveably mounted attacher, in constrast to applicant's fixedly mounted attacher. Use of a moveable attacher has certain inherent mechanical complexities as well as the safety problems attendant a rapidly thrusting exposed needle.

The Block structure has several additional disadvantages when compared to the present invention as well. The Block device is limited in that all the tags must be fed from hoppers since the feeding of the tags takes place during the cycling of the machine. Therefore, if a manufacturer wishes to put six different tags on one garment, for example, six different hoppers, (which is beyond the capability of a normal machine), must be provided. On the other hand, as explained in detail below, the cycle of the apparatus of the present invention normally begins with the tags already in place over the needle. It is therefore possible to manually place additional tags over the needle before actuating the apparatus.

A second major drawback of the Block device is that the operator cannot check to insure that all of the required tags are properly positioned on the needle before the unit is actuated. No matter how accurate automatic tag feeding units are, there is always a chance that a unit may feed no tag or two tags or may position the tag incorrectly. While this does not happen frequently, given the fact that the apparatus may contain as many as three hoppers and that the tags are not always perfectly formed, it can and does occur. Using a structure such as disclosed by Block does not permit the operator to visually ascertain whether the tags are properly fed prior to actuation of the attacher. This is because tag feeding is part of the operational cycle. If tag misfeeding occurs, the operator must undertake the time consuming task of cutting away the fasteners and refeeding new tags.

Further, Block does not teach the use of a horizontally moveable garment retaining part. In Block, the clamp does not automatically withdraw from the garment at the end of the operating cycle, hence, the needle is not exposed to facilitate manual placement of the tags.

It is, therefore, a prime object of the present invention to provide automatic apparatus for attaching tags to labels previously affixed to garments and the like.

It is another object of the present invention to provide automatic apparatus for attaching tags to labels previously affixed to garments wherein the cycling of the apparatus permits additional tags to be manually situated on the needle.

It is another object of the present invention to provide automatic apparatus for attaching tags to labels previously affixed to garments wherein the the operator can ascertain whether all of the tags have been properly situated on the needle prior to actuating the apparatus.

It is another object of the present invention to provide automatic apparatus for attaching tags to labels previously affixed to garments in which safety is enhanced by eliminating movement of the attacher needle.

It is another object of the present invention to provide an automatic apparatus for attaching tags to labels previously affixed to garments which includes a moveable anvil designed to be received between the label and the surface of the garment.

It is another object of the present invention to provide automatic apparatus for attaching tags to labels previously affixed to garments which includes a size adjustable anvil.

It is another object of the present invention to provide automated apparatus for attachings tags to labels previously affixed to garments wherein the anvil is moveable in two planes, the second plane being orthogonal with the first.

In accordance with the present invention, an apparatus is provided for automatically attaching one or more members, such as tags or the like, to an article, such as a garment. The apparatus utilizes an attacher having a hollow needle through which a fastener is dispensed. The apparatus includes a support upon which the attacher is fixedly mounted. Means are provided for positioning one or more members on the needle. Means are provided for actuating the attacher to dispense a fastener.

The improvement includes means for adapting the apparatus for use with a multi-layer article, such as a men's necktie having a selected layer, such as a label, previously affixed thereto, to which the members are to be attached. The selected layer is affixed to the remaining layers so as to define an opening therebetween. The adapting means comprises anvil means adapted to be received within the opening, with the selected layer facing the attacher. Means are provided for moving the anvil means between a position remote from the needle and a position intersecting the needle, such that the needle penetrates the selected layers, but not the remaining layers. The attacher is actuated when the anvil means is in the intersecting position. Means are provided for actuating the member positioning means upon the return of the anvil to the remote position.

Preferably the apparatus further comprises second means for moving the anvil. The second means is actuatable when the anvil is in the remote position and serves to move the anvil between a position in alignment with the needle and a position out of alignment with the needle.

Switch means are provide for actuating the operation of the apparatus. The anvil means is initially in the remote position, aligned with the needle. The switch means is positioned to be actuated as the anvil means is received in the recess and is effective, when actuated, to cause the anvil means to move to the position intersecting the needle. The attacher actuating means then causes a fastener to be dispensed. The anvil means returns to a position remote from the needle and then moves out of alignment with the needle. After the garment is removed from the needle, the member positioning means is actuated to position one or more members on the needle. Thereafter, the anvil means is moved back to a position in alignment with the needle.

Means are provided for mounting the attacher in a substantially upstanding position on the support, with the needle pointing upwardly. The remote position of the anvil is in a plane located above the needle. The anvil is moved between the remote position and the intersecting position in a substantially vertical direction. It is moved in and out of alignment in a substantially horizontal direction, within the plane of the remote position.

The anvil includes first and second elements and means for pivotally connecting the elements at one end thereof. Means are provided for adjusting the angle formed between the elements. The angle adjusting means comprises a third member situated between the first and second members. A pinion is rotatably mounted on the third member. Rack means extend between the pinion and the first and second elements, respectively.

The anvil moving means comprises a first pneumatic cylinder for moving the anvil means vertically between the remote and intersecting positions. A second anvil moving means, in the form of a second pneumatic cylinder, moves the anvil means horizontally between the aligned position and the out of alignment position. Thus, the first and second pneumatic cylinders move the anvil means in substantially orthogonal directions.

To these and such objects which may hereinafter appear, the present invention relates to automatic apparatus for attaching tags to labels affixed to garments, as described in detail in the following specification and recited in the annexed claims, taken together with the accompanying drawings wherein like numerals refer to like parts and in which:

FIGS. 5 and 6 are respectively front and side views of the illustrated portion of the apparatus in the penetration position;

Figure 14:
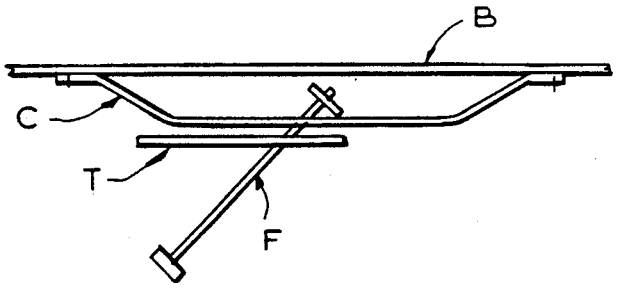
Figure 13:
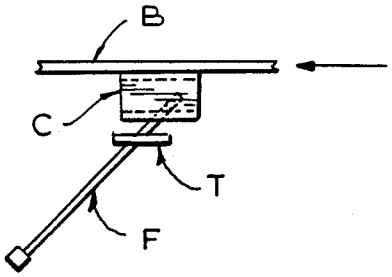
Figure 15:
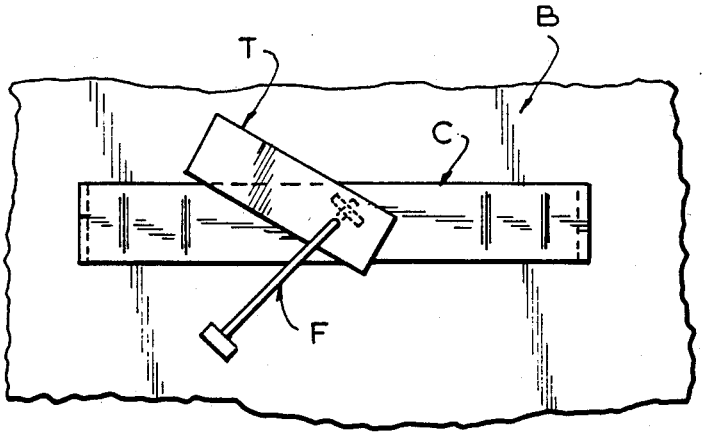
Figure 16:
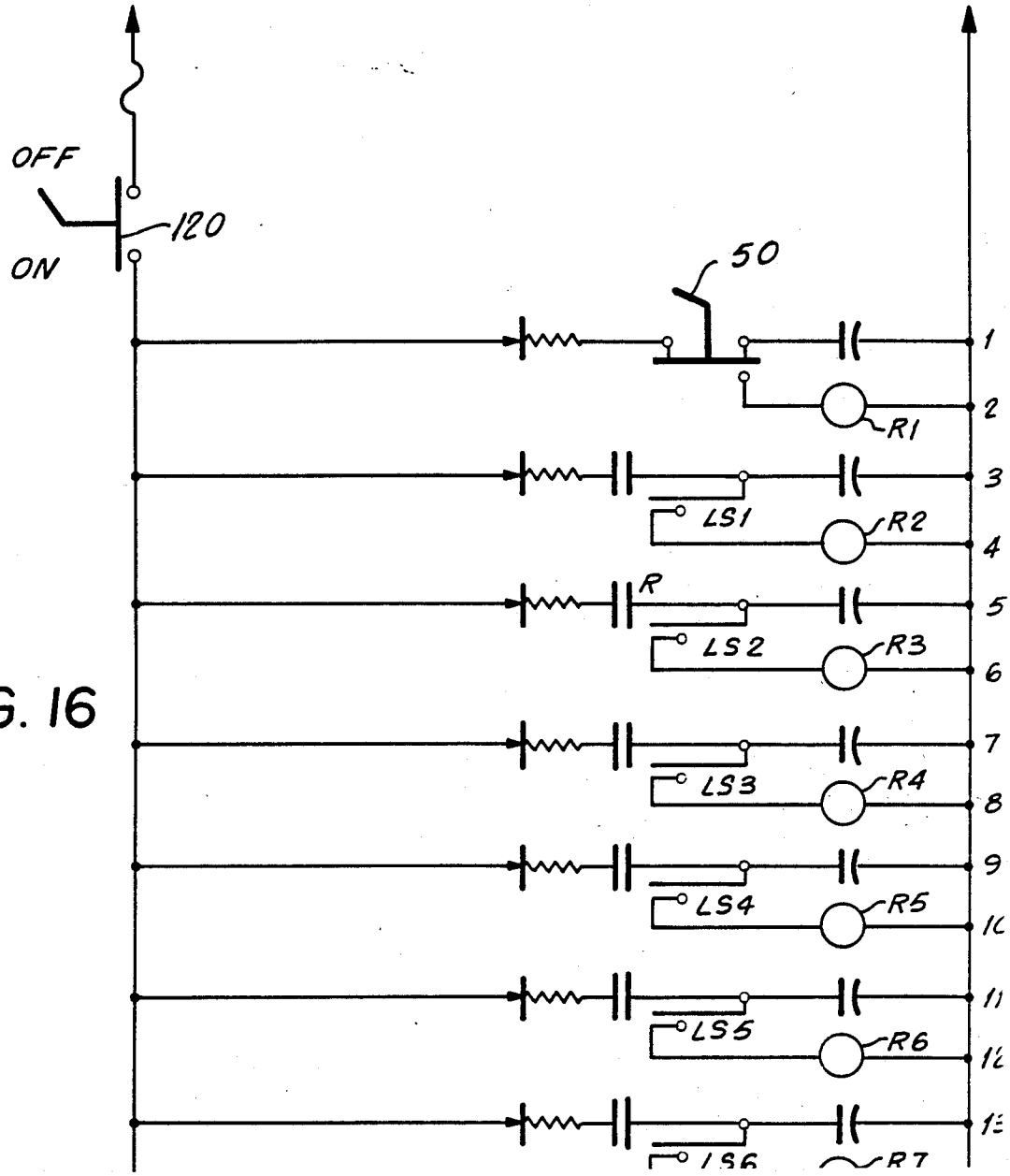

FIGS. 13, 14 and 15 respectively show side, front and bottom views of a section of a neck-tie with a tag affixed to a woven label by a fastener;

FIG. 16 is a schematic diagram of electrical control circuit of the present invention; and FIG. 17 is a schematic diagram of the pneumatic system of the present invention.

The present invention is intended to improve an automatic tag attaching apparatus by permitting same to automatically attach one or more tags to a selected layer of a multi-layer article, for instance a neckie or a shirt which has a woven label sewn therein. Such an article cannot be tagged with conventional automatic tag attaching apparatus because the operation of such apparatus would result in the fastener penetrating the garment as well as the label, hence making same unsaleable.

The present invention is intended as an improvement to commercially available automatic tag attaching apparatus such as the apparatus described in my U.S. Pat. No. 4,235,161. However it can be utilized with other types of tag attaching apparatus and it is not a requirement of the present invention that it be used only on the apparatus described in my patent.

Because of the mechanical complexity of the automatic tag attaching apparatus disclosed in my patent and in particular the fact that one, two or three automatic tag feeders or automatic hook feeders can be utilized, the drawings herein have been greatly simplified, with some components being illustrated in schematic form. In particular, the tag feeding and/or hook feeding apparatus has not been illustrated but should be understood to be of the structure and function described in my patent or any comparable apparatus. Hence, the drawings disclose the anvil means in detail but illustrate only a portion of the attacher, which is commercially available and conventional. The attacher is fixedly mounted on a support in a substantially upstanding position. Illustrated schematically are the means for mounting the anvil means and other conventional parts.

Figure 1:
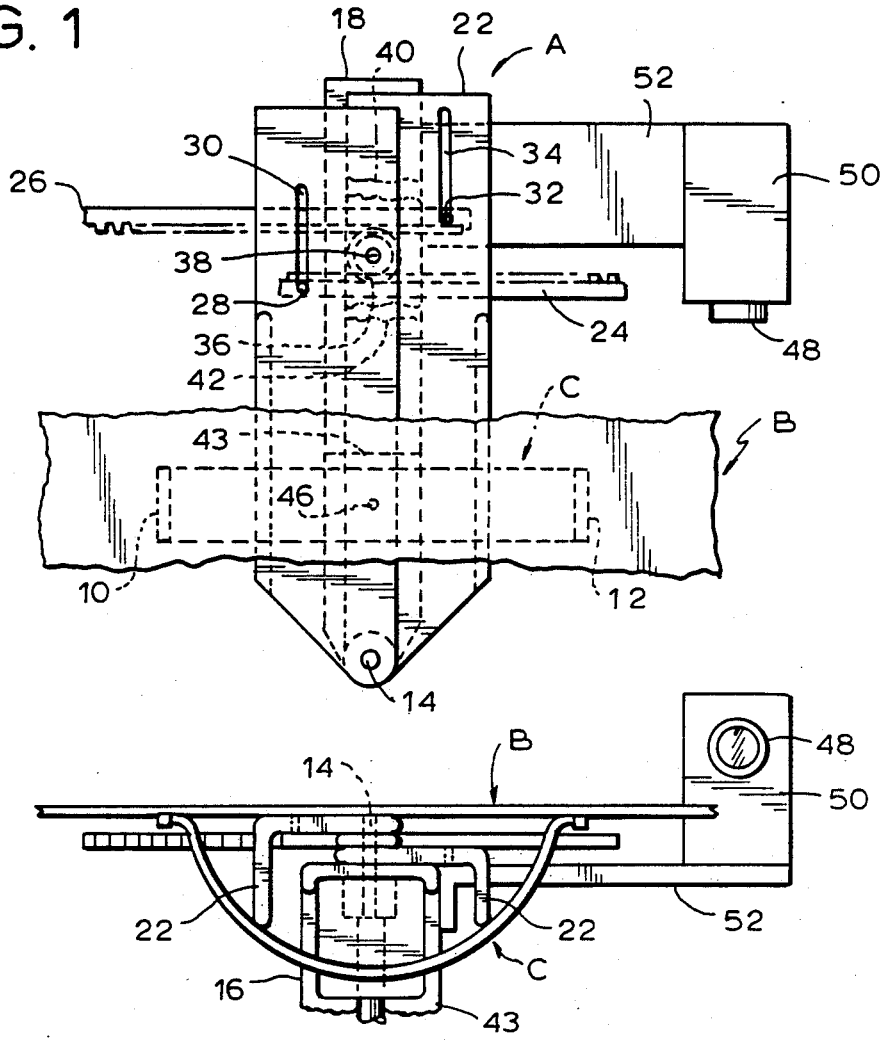
FIG. 1 is a top plan view of the anvil means of the present invention in the contracted position showing same inserted between a label a garment.

FIG. 1 is a top view of the anvil means of the present invention, generally designated A. Anvil means A is essentially a hollow garment engaging member which has a tapered forward portion to facilitate insertion between the surface of a garment, generally designated B, such as a man's neck-tie or shirt collar and a woven label, generally designated C, which is affixed at either end 10, 12 thereof to garment B by stitching or the like.

Figure 5:
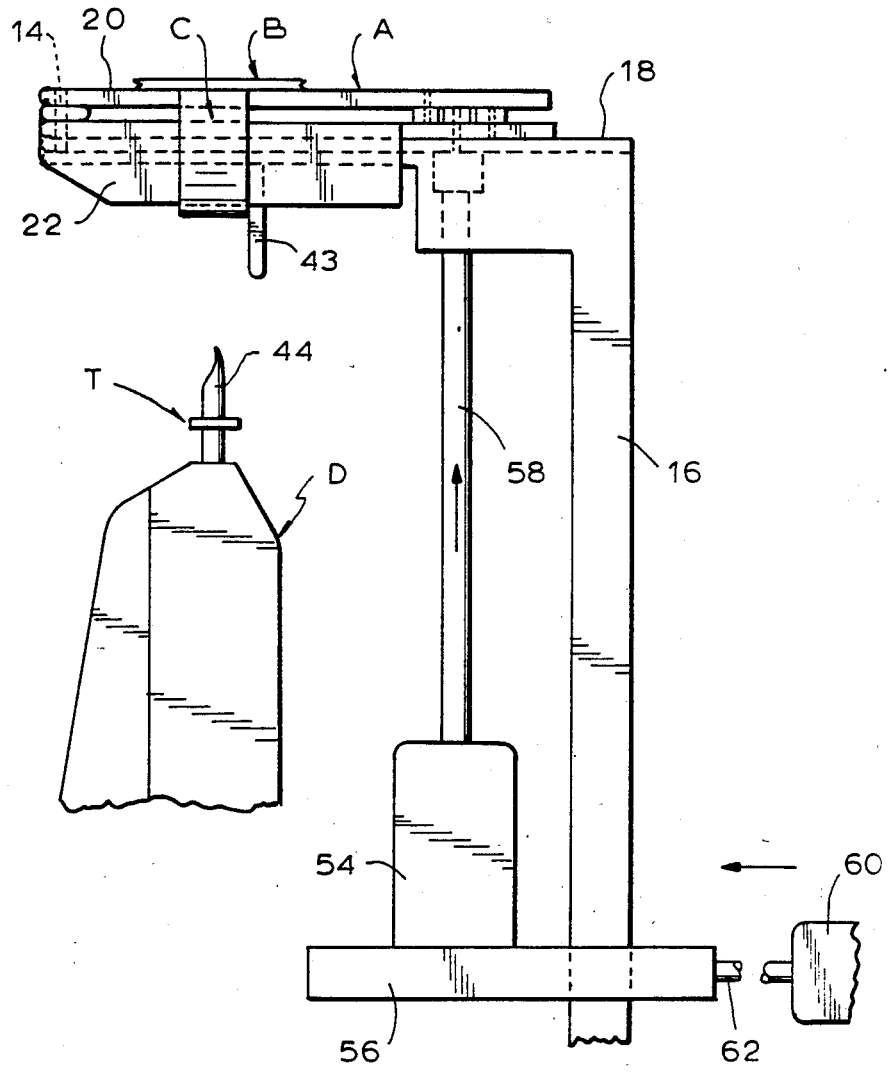
FIG. 5 is a side view of the portion of the apparatus shown in FIG. 4.

Anvil means A comprises three parts which are connected together by a shaft 14 proximate the forward end. Referring for a moment to FIG. 5 which is a side view of anvil means A, the anvil consists of an upstanding support 16 which is both vertically and horizontally movable relative to a table top-like support (not shown) as will be described in detail below. pstanding support carries horizontally extending portion 18 from which shaft 14 extends and upon which parts 20 and 22 of anvil A are mounted. Parts 20 and 22 are pivotally connected by shaft 14. Each carries a rack 24, 26 respectively. In particular, rack 24 is connected by a pin 28 and a slot 30 arrangement to part 20. Pin 28 extends upwardly from rack 24 into slot 30 in part 20. Similarly, a pin 32 extends upwardly from rack 26 through a slot 34 on part 22. Racks 24 and 26 are engaged by a pinion gear 36 which is rotatable about a shaft 38 mounted on part 18. Upwardly extending elements 40 and 42 on part 18 serve to maintain the respective racks in position with respect to pinion 36.

The size of anvil A and in particular the angle between parts 20 and 22 can be adjusted. It is desired to be able to adjust the size of the anvil to fit the opening between garment B and label C such that when the anvil is properly positioned within the opening, the label will be held taut, at a position spaced from the other layers of the garment, facing and in alignment with the axis of the needle of the attacher.

Figure 2:
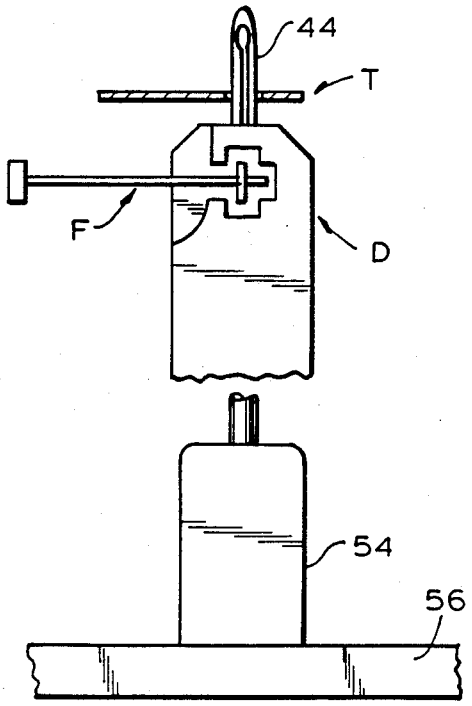
FIG. 2 is a front view of the anvil shown in FIG. 1 and a part of the attacher.
Figure 3:
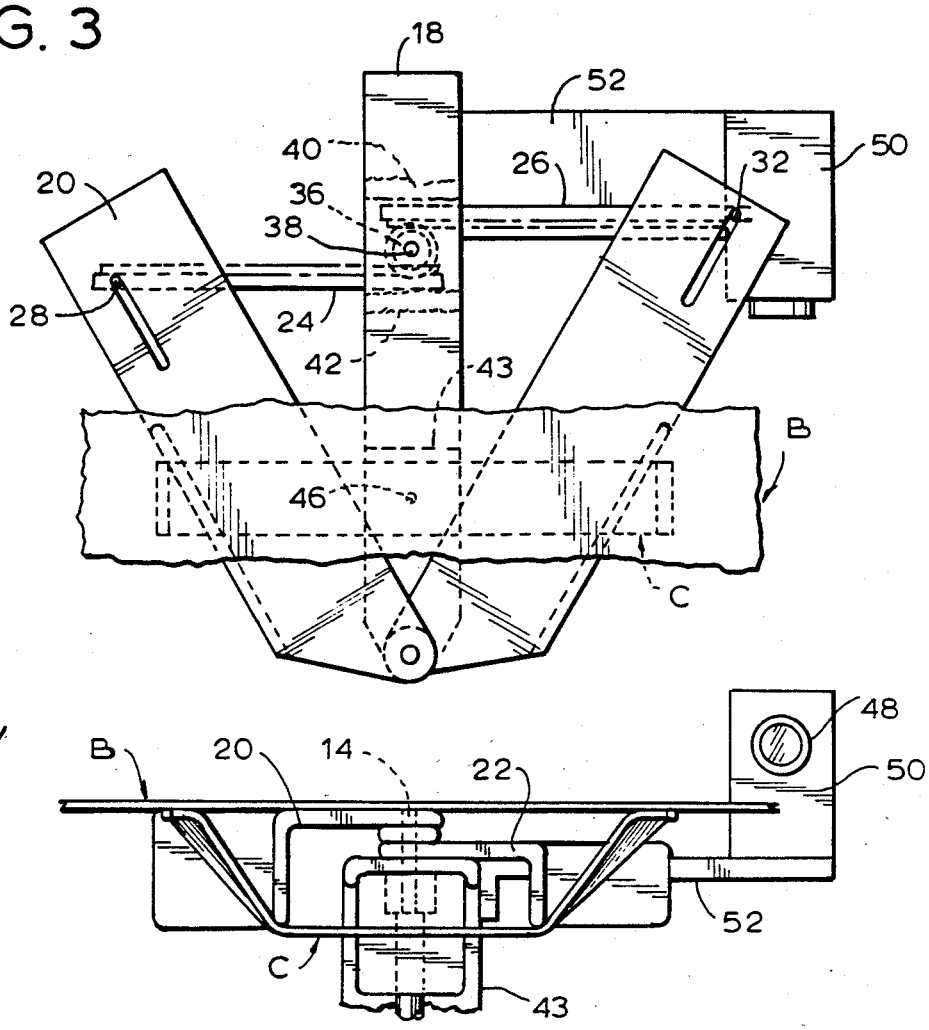
FIG. 3 is a view similar to FIG. 1 with the anvil means in the fully extended position.

FIG. 1 and 2 show the anvil means in its compressed state. It is readily apparent from FIG. 2 that with anvil means A in this state, label C is not taut and could be in any horizontal position with respect to the axis of the needle. However, in FIGS. 3 and 4, the anvil means has been adjusted to the appropriate size such that label C is held taut (see FIG. 4) and at a horizontal position exactly in alignment with the axis of the needle of the attacher when the edge of the label abuts stop 43.

Once the anvil has been appropriately sized for a particular style garment and label, it need not be readjusted until different style garments are being operated upon. Adjustment of the size of the anvil is preferably performed by engaging a slot (not shown) on top of pinion 36 by a screw driven or the like and rotating the pinion to pivot parts 20 and 22 relative to each other.

Figure 4:
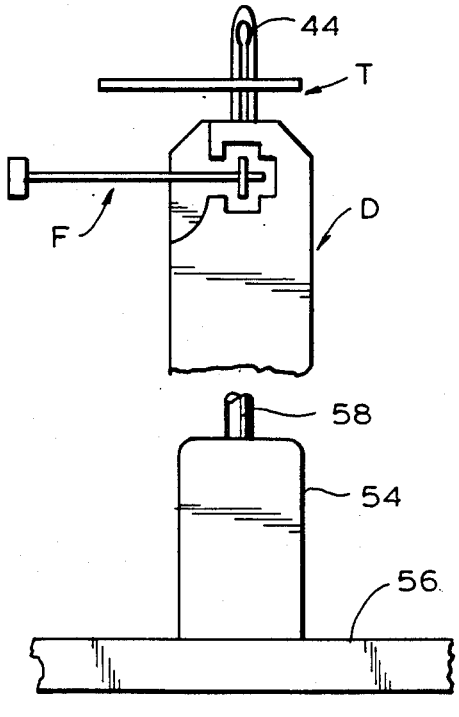
FIG. 4 shows a portion of the apparatus of the present invention including the anvil means of FIG. 3 with the attacher in the ready position.

As illustrated in FIGS. 4 and 5, in the "ready state", one or more tags, generally designated T, have been placed on needle 33 of the attacher, generally designated D, which is vertically mounted to the support. A clip or coil of fasteners, generally designated F, loaded into attacher D. Anvil means A is in its initial position, spaced above attacher D but in horizontal alignment with the axis of needle 44.

The operator places garment B over the previously adjusted anvil means A such that the forward end of the anvil is received in the opening between label C and the surface of garment B, the edge of the label abuts stop 43 such that the center of the label is aligned with the axis of needle 44, indicated as 46 on the drawings. As the operator positions the garment over the anvil means A, his finger comes in contact with the spring-loaded actuator 48 of a switch 50. Switch 50 is mounted by means of a bracket 52 to support 16. The switch is positioned so that it is automatically depressed as the garment is positioned on the anvil. Switch 50 is not illustrated in FIGS. 5 through 12 for simplicity.

Figure 6:
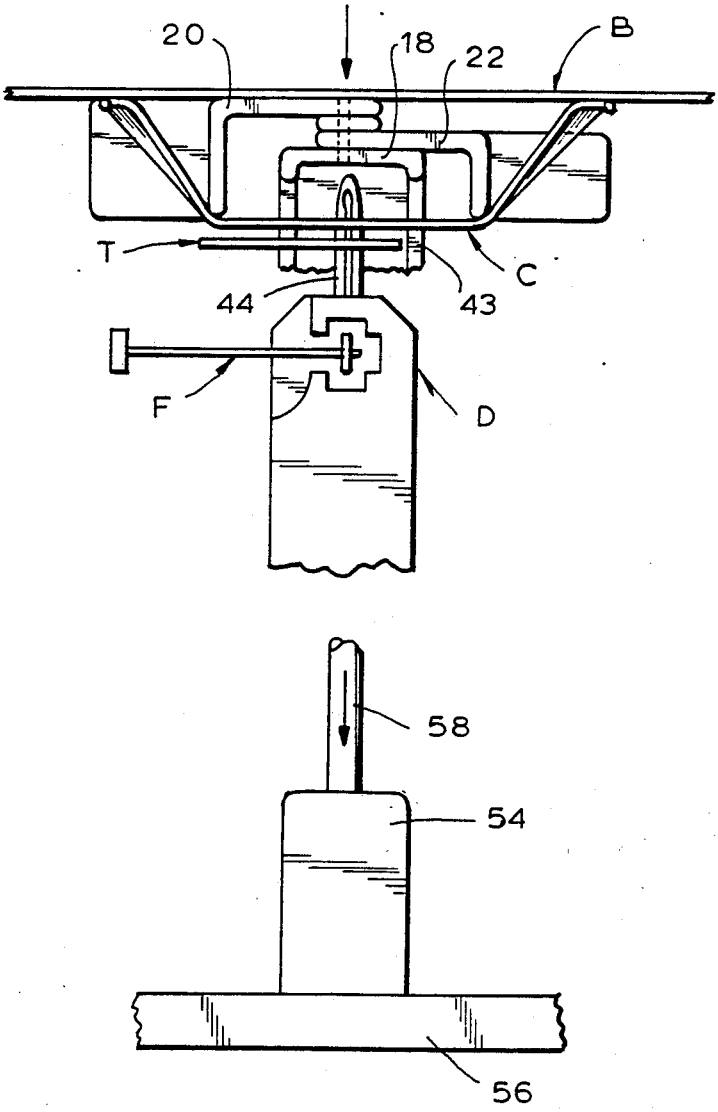
Figure 7:
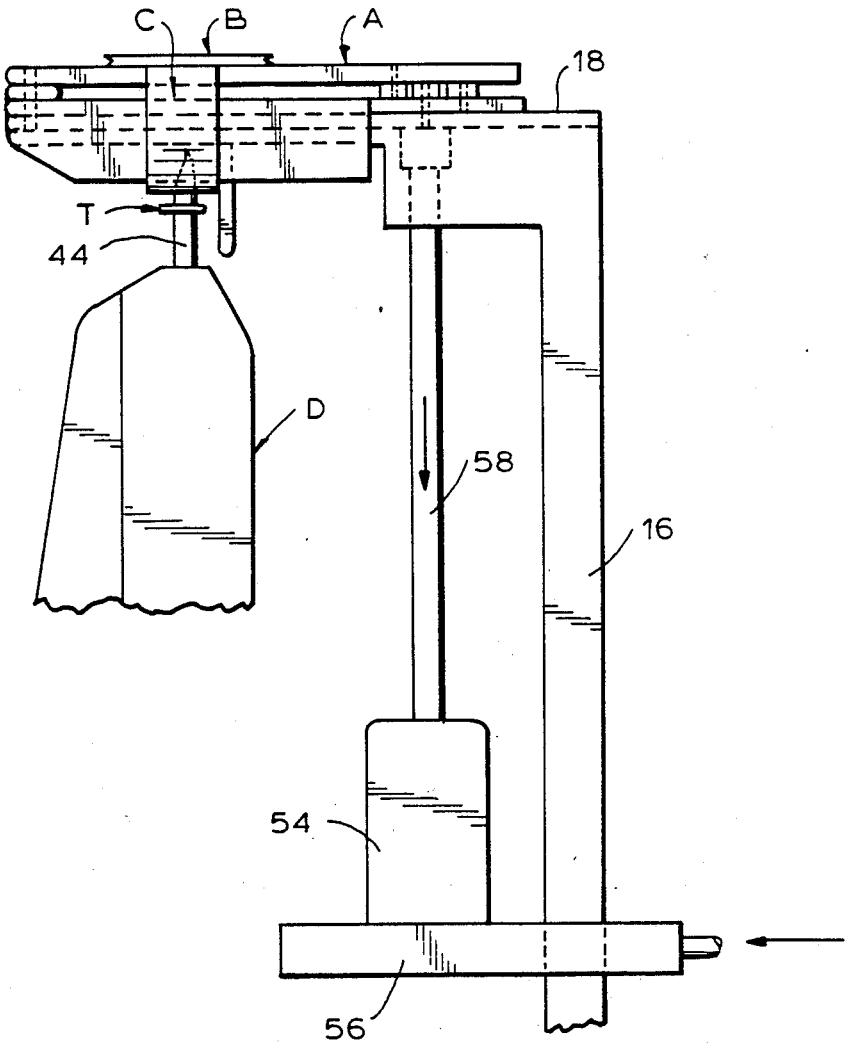

Actuation of switch 50 causes the anvil means A to move from the remote position to a position in which needle 44 intersects the plane of the anvil means A and, in particular, penetrates label C, but not the garment itself, as illustrated in FIGS. 6 and 7. A pneumatic cylinder 54 of conventional design is mounted on a bracket 56 which in turn is movable along the surface of the attacher support (not shown). Extending from cylinder 54 is a piston rod 58. The end of rod 58 is affixed to the undersurface of support 18 of anvil means A. Upon actuation by switch 50, rod 58 retracts a short distance into cylinder 54, and anvil means A moves vertically downwardly intersecting the plane of needle 44 such that needle 44 penetrates label C.

Figure 8:
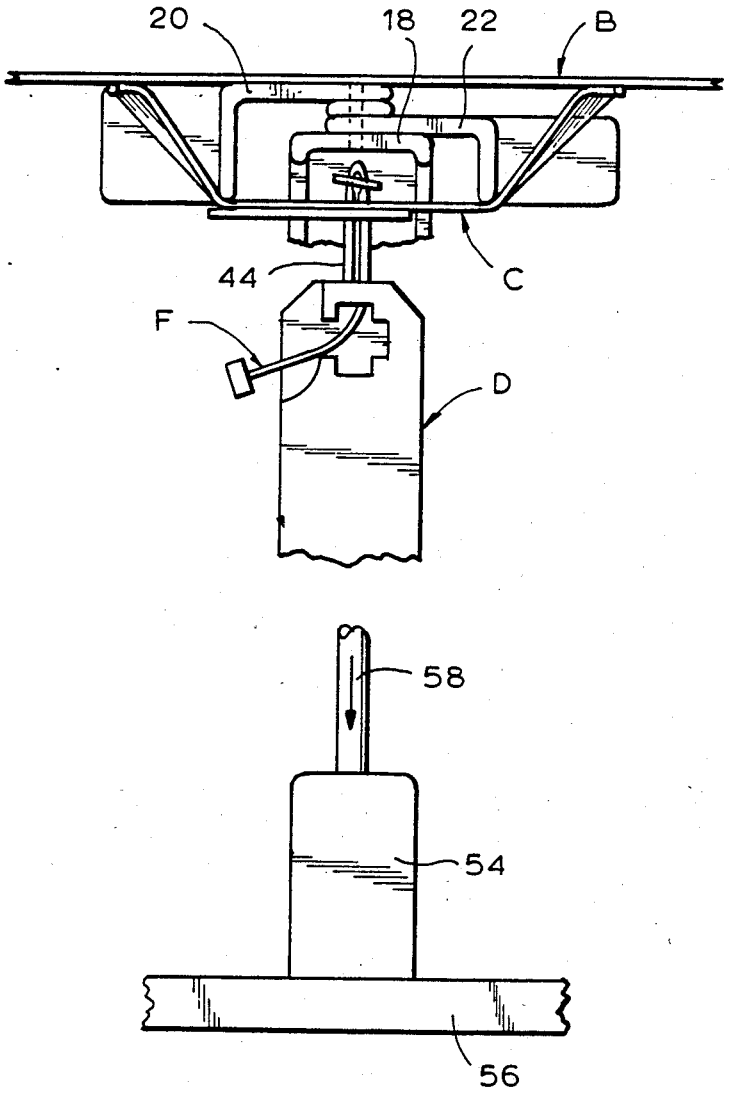
FIGS. 8 and 9 are respectively front and side views of the portion of the apparatus of the present invention in the position where the attacher has been actuated to dispense a fastener.
Figure 9:
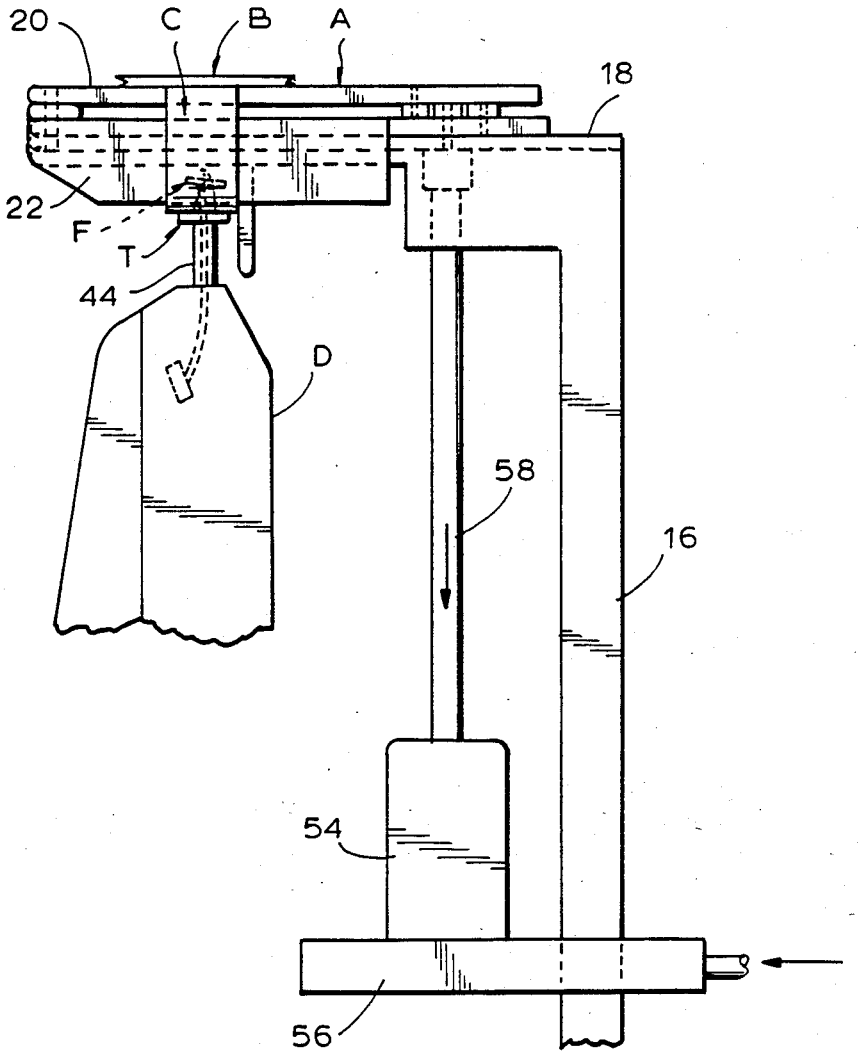

When piston rod 56 reaches the end of its path of travel, an appropriately located limit switch (now shown) is tripped, actuating the pneumatic cylinder which controls the position of the trigger of attacher D to depress the trigger and cause actuator D to dispense a fastener through needle 44. The T-bar end of the dispensed fastener is then situated between label C and garment B. The apparatus now appears as illustrated in FIGS. 8 and 9.

Figure 10:
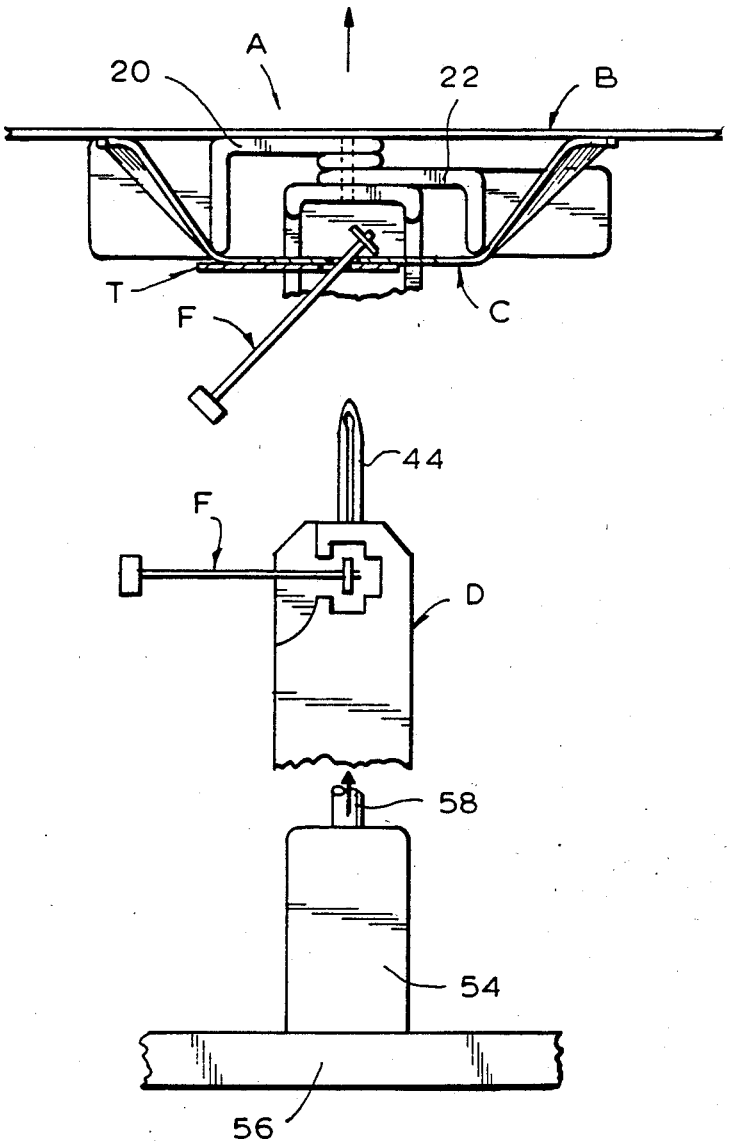
FIG. 10 and 11 are respectively front and side views of the portion of the apparatus showing the anvil having returned to the remote position and hence withdrawn from the needle.
Figure 11:
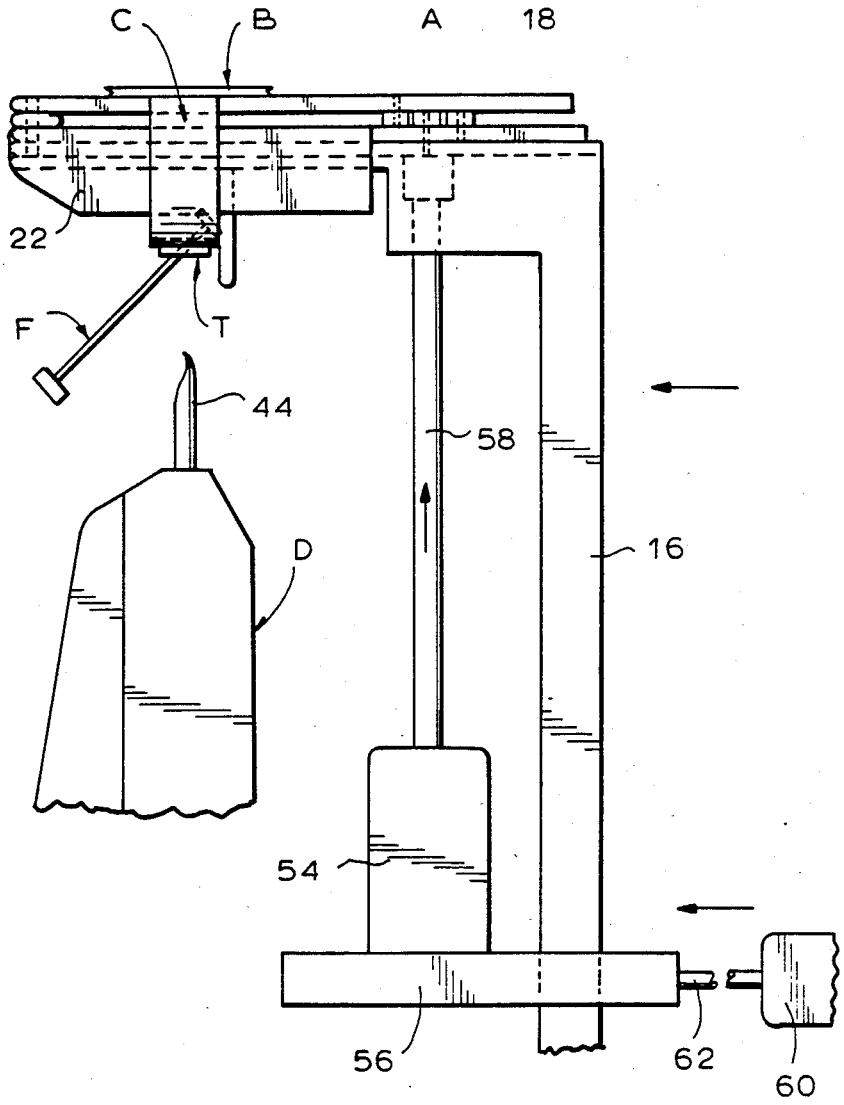

After a delay sufficient to permit attacher D to be actuated and the fastener F to be dispensed, cylinder 54 is actuated in the opposite direction to cause piston rod 58 to extend, thereby moving anvil means A back to its remote position, spaced from needle 44, as illustrated in FIGS. 10 and 11. As the anvil means reaches its remote position, an appropriately positioned limit switch (not shown) is tripped causing the tag feed means, which may comprise one or more automatic tag feeders, to place one or more tags T on the needle 33 such that the tags T are already positioned on needle 44 before the next operation commences. If desired, a short time delay may be incorporated into the control mechanism to facilitate removal of the tagged garment before new tags are placed on the needle.

It should be appreciated that applicant's apparatus positions tags T on the needle at the end of the operation cycle. This permits the operator to manually inspect the apparatus to insure that the proper number of tags are positioned on the needle, as well as to manually place more tags over the needle if necessary, before the next cycle is initiated.

Figure 12:
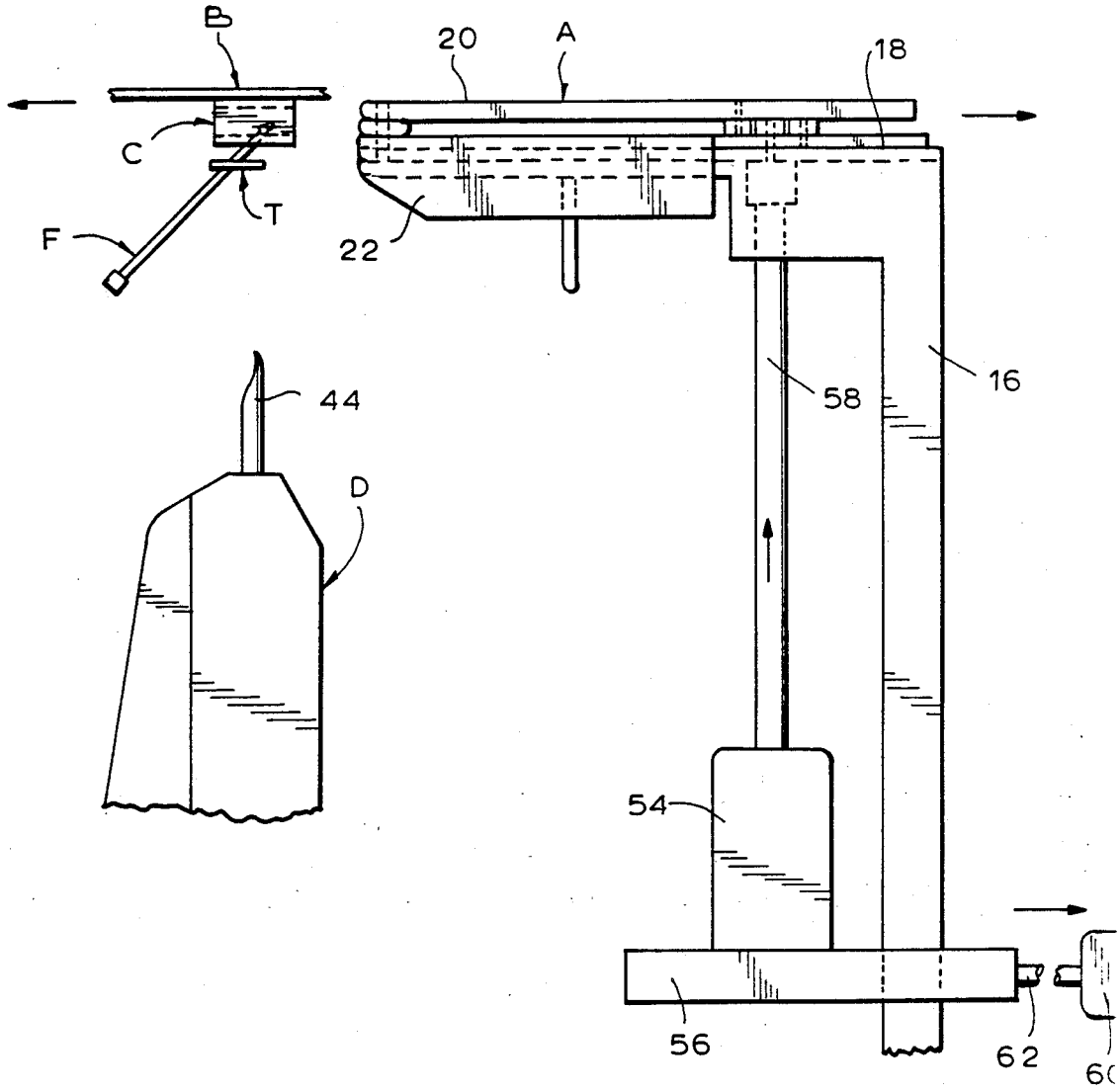
FIG. 12 is a side view of the apparatus showing the anvil means having moved from a position in alignment with the needle to a position outside of alignment with the needle as the garment is removed therefrom.

What has been described above is the operation of a first preferred embodiment of the present invention. In the first preferred embodiment, the anvil is movable with respect to the attacher in only a single direction, that is, substantially vertically. The second preferred embodiment of the present invention, as described below, includes additional structure which permits the anvil to be moved in the horizontal direction substantially orthogonal to the vertical movement. This additional feature is schematically illustrated in FIG. 12 and explained with reference thereto.

The second preferred embodiment of the present invention is identical in structure and function to the first preferred embodiment, with the addition of a second pneumatic cylinder 60 which is mounted on the attacher support and connected to a bracket 56 by means of a piston rod 62. Bracket 56 is movably mounted on the surface. of the attacher support (not shown) for movement there along in a substantially horizontal direction. Since support 16 is mounted on bracket 56, anvil A will move horizontally along with the movement of bracket 56. Bracket 56 and hence anvil A remain in position in alignment with needle 44 prior to the return of the anvil to its remote position. At this point, in the second embodiment, a limit switch (not shown) is tripped causing cylinder 60 to be actuated. The actuation of cylinder 60 causes piston rod 62 to retract such that anvil A is moved towards the right (as seen in FIG. 12) out of alignment with the attacher D. If the tagged garment is held by the operator as anvil A is moved away from the attacher, anvil A will automatically be withdrawn from the garment as illustrated in FIG. 12. Upon anvil A reaching its rearwardmost position, the direction of actuation of cylinder 60 is reversed and rod 62 extends moving bracket 54 and hence anvil A back into alignment with needle 44 such that the apparatus again appears as illustrated in FIG. 11, except that the garment B and tag label C have been removed therefrom. The tag feed means may be actuated to fed new tags onto needle 44 either when anvil A is out of alignment with needle 44 or after it has moved back into alignment. The apparatus is now again in the "ready" condition, as illustrated in FIGS. 4 and 5.

FIGS. 13, 14 and 15 respectively show side, front and bottom views of a section of a neck-tie which has been tagged using the apparatus of the present invention. It should be noted that the fastener F now anchors tag T to label C but does not penetrate through garment B or in any way mutiliate or otherwise make the garment unsaleable. Inserting a fastener into a multi-layered article in this automated fashion would be impossible with the automatic tag apparatus such as the type illustrated in my patent.

FIGS. 16 and 17 are, respectively, a schematic diagram of the electrical system and a schematic diagram of the pneumatic system which control the sequence of operations of the second preferred embodiment of the present invention. In order to perform as the first preferred embodiment of the present invention, pneumatic cylinder 60 and the corresponding relays are simply disconnected, a task well within the skill of the ordinary artisan. Assume that prior to beginning the operation the components are as illustrated in FIGS. 4 and 5, that is, anvil means A is in the remote position, in alignment with the needle axis, the attacher trigger is in the non-actuated state and the tag feed means have already placed one or more tags over the needle.

Referring to FIG. 16, the parallel circuits are designated by the line (1 through 21) upon which same appears. Line 2 contains the contact for switch 50 which is depressed to initiate the operation of the apparatus. Seven relays, R1, R2, R3, R4, R5 and R6 are provided, operably connected to contacts correspondingly, labeled. The relay contacts control four double solenoid valves labeled 110, 112, 114 and 116. Each solenoid comprises two halves, labeled a and b, respectively, one of which has pneumatic connections which are reversed with respect to the other in the pair so as to move the piston therein in one of two selected directions.

As seen in FIG. 17, each of the solenoids 110, 112, 114 and 116 is connected to a source of air under pressure (not shown) by means of an input conduit 118. The air from the source passes through a cut-off valve 100, a filter 102, a pressure regulator 104 and a lubricator 106, all of conventional design, prior to entering the solenoid air inputs. Each valve has two ports, an input port which is connected to conduit 118 and an exit port vented to the atmosphere.

Depression of an on/off switch 120 serves to energize the circuit of FIG. 16. The operator places the article to be tagged on anvil means A and depresses the actuator of switch 50 which energizes a relay R1 on line 2 closing contacts R1 on line 15 to actuate valve 110*a* so as to cause piston rod 58 to retract in solenoid 54 and cause anvil means A to move vertically downward from the remote position to the intersecting position. Once the intersecting position is attained, an appropriately located limit switch LS1 is actuated causing a relay R2 on line 4 to energized. The energization of relay R2 causes the contacts R2 on line 16 to close, actuating solenoid valve 112*a* causes the piston rod 113 of the trigger control solenoid 115 to retract, actuating the attacher to dispense a fastener.

When the trigger control solenoid piston rod 113 is fully retracted, an appropriately positioned limit switch LS2 is closed. The closing of the contacts limit switch LS2 causes a relay R3 on line 6 to be energized. The energization realy R3 causes contacts R3 on line 17 to close, actuating valve 112*b*, thereby causing piston rod 113 of the trigger control solenoid 115 to extend such that the next fastener is brought into alignment behind needle 44.

After the piston rod 113 of the trigger control solenoid 115 is fully extended, an appropriately placed limit switch LS3 is actuated, thereby energizing relay R4 on line 8. The energization of relay R4 causes contacts R4 on line 18 to close, actuating valve 110*b* such piston rod 58 of solenoid 54 extends, causing anvil means A to move more vertically upwards, returning to its remote position.

Upon reaching its remote position, anvil means A trips an appropriately located limit switch LS4 causing relay 5 on line 10 to be energized. The energization of relay 5 causes contacts R5 on line 19 to close, actuating valve 114*a*. The actuation of valve 114*a* causes the piston rod 62 associated with solenoid 60 to retract, thereby moving anvil means A horizontally from its in aligned position to its out of alignment position with respect to needle 44. This causes the anvil means A to withdraw from the garment.

At this point the circuitry can be fashioned in one of two ways. Either solenoid 60 can be actuated first to extend rod 62 and thereafter the tag feed solenoid 117 can be actuated or the tag feed solenoid 117 can be actuated first and thereafter solenoid 60 can be actuated. FIG. 16 illustrates the second of these sequences, which is preferred. However, it should be understood that either sequence of operation can be adapted.

As shown in FIG. 16, after anvil means A has moved horizontally to its out of alignment position, an appropriately positioned limit switch LS5 is tripped, energizing relay R6 on line 12. The energization of relay R6 causes contacts R6 on line 20 to close actuating valve 116*a* which causes the tag feed mechanism to place one or more tags on needle 44. It should be appreciated while only a single tag feed solenoid 117 is illustrated for simplicity, the tag feed mechanism may include, several solenoids and an appropriate number of control valves therefor. However, since such tag feed mechanism and the solenoids and valve controls therefor are known in the art and commercially available, the description of the operation thereof is not included herein.

An appropriately placed limit switch LS6 is tripped when the tag feed mechanism has completed its cycle of operation. The tripping of limit switch LS6 causes relay R6 on line 14 to be energized. The energization of relay R7 causes contacts R7 on line 21 to close, actuating valve 114*b* such that rod 62 of solenoid 60 extends, moving anvil means A back into its position in alignment with needle 44. This concludes the cycle of operation.

It may be preferable to include an adjustable delay between the time limit switch LS6 is tripped and the time relay R6 is energized to permit the operator to manually place one or more tags over needle 44 prior to anvil means A returning its aligned position. Adjustable electrical or pneumatic delays are known in the art for this purpose and it is well within the skill of the ordinary artisan to include same at the appropriate location in either the electrical circuit of FIG. 16 or the pneumatic circuit of FIG. 17 in order to obtain the desired time delay.

It should now be appreciated that the present invention relates to an improvement for automatic tag attaching apparatus which permits the apparatus to automatically affix tags to garments which have labels previously affixed thereto and to do so without mutilating or damaging the garment in any way. This object is achieved through the use of a size adjustable anvil adapted to be inserted in the opening between the layers of the multi-layer article. As this occurs, the actuator switch of the apparatus is automatically depressed, causing the anvil to move from a remote position to a position intersecting the needle such that the needle penetrates only the label and not the garment itself. At this point, the attacher is actuated dispensing a fastener. The anvil is then returned to its remote position, such that the needle is withdrawn from the label leaving the fastener anchored to the label with the tag thereon. The cycle is completed by actuating the tag feeders which feed tags over the needle.

In a second preferred embodiment, prior to the actuation of the tag feed mechanism, the anvil is moved horizontally out of alignment with the needle such that it withdraws from the opening between the layers of the garment. It then returns to a position in alignment with the needle. The tag feed mechanism can be actuated before or after the anvil returns to its aligned position.

While only two preferred embodiments of the present invention has been disclosed for purposes of illustration it is obvious that many variations and modifications could be made thereto, it is intended to cover all these variations and modifications which fall within the scope of the present invention as defined by the following claims:

I claim:

1. In an apparatus for automatically attaching one or more members to an article utilizing an attacher having a hollow needle through which a fastener is dispensed, the apparatus being of the type which has a support upon which the attacher is fixedly mounted, means positioning one or more members on the needle and means for actuating the attacher to dispense a fastener, the improvement comprising means for adapting the apparatus for use with a multi-layer article, to which the members are to be attached to only selected layers, the selected layers and the remaining layers defining an opening therebetween, said means comprising anvil means adapted to be received within said opening with the selected layers facing the attacher and means for moving said anvil means between a position remote from the needle and position intersecting the needle such that the needle penetrates the selected layers but not the remaining layers, means for actuating said attacher when said anvil means is in said intersecting position means and means for actuating said member positioning means in response to the movement of said anvil means to said remote position.

2. The apparatus of claim 1 further comprising switch means for actuating said anvil moving means and wherein said switch means is positioned to be actuated as said anvil means is received in said opening.

3. The apparatus of claim 1 further comprising means for mounting said attacher in a substantially upstanding position on said support with the needle pointing upwardly and wherein said remote position of said anvil means is a plane located above the needle.

4. The apparatus of claim 3 wherein said movement of said anvil means between said remote position and said intersecting position is substantially vertical.

5. The apparatus of claim 1 wherein said anvil means comprises size adjusting means.

6. The apparatus of claim 1 wherein said anvil means comprises first and second elements, means for pivotally connecting said elements at one end thereof and means for adjusting the angle formed between said elements.

7. The apparatus of claim 6 wherein said angle adjusting means comprises a third member situated proximate said first and second members, a pinion rotatably mounted on said third member and rack means extending between said pinion and said first and second elements, respectively.

8. The apparatus of claim 1 further comprising second means for moving said anvil means between a position in alignment with the needle and position out of alignment with the needle.

9. The apparatus of claim 1 wherein said attacher actuating means is actuated upon the anvil means reaching said intersecting position.

10. The apparatus of claim 1 wherein said anvil moving means comprises a first pneumatic cylinder.

11. The apparatus of claim 10 wherein said second anvil moving means comprises a second pneumatic cylinder.

12. The apparatus of claim 11 wherein said first and second pneumatic cylinders move said anvil means in substantially orthogonal directions.

13. The apparatus of claim 1 wherein said movement of said anvil means between said remote position and said intersecting position is substantially vertical.

14. The apparatus of claim 8 wherein said movement of said anvil means between said aligned position and said out of alignment position is substantially horizontal.

15. In an apparatus for automatically attaching one or more members to an article utilizing an attacher having a hollow needle through which a fastener is dispensed the apparatus being of the type which has a support upon which the attacher is fixedly mounted, means for positioning one or more members in the needle and means for actuating the attacher to dispense a fastener, the improvement comprising means for adapting the apparatus for use with a multi-layer article in which the fastener is to be attached to selected layers only, the selected layers and remaining layers defining an opening therebetween, said means comprising hollow opening engaging means and means for moving said engaging means, said engaging means moving means comprising first means for moving said engaging means between a position remote from the needle and a position intersecting same and second means for moving said engaging means between a position in alignment with the needle and a position out of alignment with the needle.

16. The apparatus of claim 15 further comprises means for adjusting the size of said engaging means.

17. The apparatus of claim 15 further comprising means for actuating said member positioning means in response to the movement of said engaging means to said aligned position.

18. The apparatus of claim 15 further comprising means for actuating said attacher when said engaging means is in said intersecting position.

19. The apparatus of claim 15 further comprising means for actuating said second means for moving said engaging means from the aligned position to the out of alignment position in response to the movement of said engaging means to said remote position.

20. The apparatus of claim 16 further comprising means for actuating said second means for moving said engaging means from the aligned position to the out of alignment position in response to the movement of said engaging means to said remote position.

21. The apparatus of claim 19 further comprising means for actuating said second means for moving said engaging means from the out of alignment position to the aligned position in response to the movement of said engaging means to the out of alignment position.

* * * * *